US006887350B2

(12) United States Patent
Garnier et al.

(10) Patent No.: US 6,887,350 B2
(45) Date of Patent: May 3, 2005

(54) TISSUE PRODUCTS HAVING ENHANCED STRENGTH

(75) Inventors: Gil Bernard Didier Garnier, Neenah, WI (US); Maurizio Tirimacco, Appleton, WI (US); Jeremy Richard Beard, Menasha, WI (US); Richard Joseph Behm, Appleton, WI (US); Sheng-Hsin Hu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 95 days.

(21) Appl. No.: 10/319,415

(22) Filed: Dec. 13, 2002

(65) Prior Publication Data

US 2004/0112558 A1 Jun. 17, 2004

(51) Int. Cl.[7] ..... D21F 11/14; D21F 27/38

(52) U.S. Cl. ..... 162/135; 162/158; 162/169; 162/168.1; 162/146; 162/125

(58) Field of Search ..... 162/109, 111–113, 162/117, 123, 125, 135, 146, 141, 158, 169, 204, 168.1, 164.1; 427/363, 391

(56) References Cited

U.S. PATENT DOCUMENTS

| | | | | |
|---|---|---|---|---|
| 2,345,543 | A | 3/1944 | Wohnsiedler et al. | |
| 2,745,744 | A | 5/1956 | Weidner et al. | |
| 2,926,116 | A | 2/1960 | Keim | |
| 2,926,154 | A | 3/1960 | Keim | |
| 3,104,198 | A * | 9/1963 | Brissette | 162/146 |
| 3,256,138 | A * | 6/1966 | Welch et al. | 162/124 |
| 3,556,932 | A | 1/1971 | Coscia et al. | |
| 3,556,933 | A | 1/1971 | Williams et al. | |
| 3,700,623 | A | 10/1972 | Keim | |
| 3,772,076 | A | 11/1973 | Keim | |
| 3,812,000 | A | 5/1974 | Salvucci, Jr. et al. | |
| 3,821,068 | A | 6/1974 | Shaw | |
| 3,844,880 | A | 10/1974 | Meisel, Jr. et al. | |
| 3,862,877 | A | 1/1975 | Camden | |
| 3,879,257 | A | 4/1975 | Gentile et al. | |
| 3,885,158 | A | 5/1975 | Flutie et al. | |
| 3,899,388 | A | 8/1975 | Petrovich et al. | |
| 3,903,342 | A | 9/1975 | Roberts, Jr. | |
| 3,994,771 | A | 11/1976 | Morgan, Jr. et al. | |
| 4,018,647 | A | 4/1977 | Wietsma | |
| 4,057,669 | A | 11/1977 | McConnell | |
| 4,081,318 | A | 3/1978 | Wietsma | |
| 4,099,913 | A | 7/1978 | Walter et al. | |
| 4,121,966 | A | 10/1978 | Amano et al. | |
| 4,125,659 | A | 11/1978 | Klowak et al. | |
| 4,129,528 | A | 12/1978 | Petrovich et al. | |
| 4,147,586 | A | 4/1979 | Petrovich et al. | |
| 4,158,594 | A | 6/1979 | Becker et al. | |
| 4,208,459 | A | 6/1980 | Becker et al. | |
| 4,222,921 | A | 9/1980 | Van Eenam | |
| 4,237,818 | A | 12/1980 | Clifford et al. | |
| 4,326,000 | A | 4/1982 | Roberts, Jr. | |
| 4,351,699 | A | 9/1982 | Osborn, III | |
| 4,392,861 | A | 7/1983 | Butterworth et al. | |
| 4,441,962 | A | 4/1984 | Osborn, III | |
| 4,447,294 | A | 5/1984 | Osborn, III | |
| 4,507,173 | A | 3/1985 | Klowak et al. | |
| 4,510,019 | A | 4/1985 | Bartelloni | |
| 4,581,254 | A | 4/1986 | Cunningham et al. | |
| 4,603,176 | A | 7/1986 | Bjorkquist et al. | |
| 4,604,313 | A | 8/1986 | McFarland et al. | |
| 4,605,702 | A | 8/1986 | Guerro et al. | |
| 4,755,421 | A | 7/1988 | Manning et al. | |
| 4,795,668 | A | 1/1989 | Krueger et al. | |
| 4,822,452 | A | 4/1989 | Tse et al. | |
| 4,849,054 | A | 7/1989 | Klowak | |
| 4,925,528 | A | 5/1990 | Tse et al. | |
| 4,940,513 | A | 7/1990 | Spendel | |
| 4,959,125 | A | 9/1990 | Spendel | |
| 5,019,211 | A | 5/1991 | Sauer | |
| 5,048,589 | A | 9/1991 | Cook et al. | |
| 5,057,368 | A | 10/1991 | Largman et al. | |
| 5,069,970 | A | 12/1991 | Largman et al. | |
| 5,094,717 | A | 3/1992 | Manning et al. | |
| 5,102,501 | A | 4/1992 | Eber et al. | |
| 5,108,820 | A | 4/1992 | Kaneko et al. | |

(Continued)

FOREIGN PATENT DOCUMENTS

| | | | | |
|---|---|---|---|---|
| EP | 0404189 A1 | 12/1990 | | |
| EP | 0465203 B1 | 1/1992 | | |
| EP | 0951603 B1 | 10/1999 | | |
| EP | 1243697 A1 | 9/2002 | | |
| WO | WO 9925924 A1 * | 5/1999 | | D21H/27/38 |
| WO | WO 0021918 A1 | 4/2000 | | |
| WO | WO 0112902 A1 | 2/2001 | | |
| WO | WO 0202871 A1 | 1/2002 | | |
| WO | WO 0214606 A3 | 2/2002 | | |
| WO | WO 0214606 A2 | 2/2002 | | |
| WO | WO 0216689 A2 | 2/2002 | | |

OTHER PUBLICATIONS

U.S. Appl. No. 10/005,882, filed Dec. 3, 2001, Hu, et al., Tissue Products Having Reduced Lint And Slough.

U.S. Appl. No. 10/267,050, filed Oct. 8, 2002, Hu, et al., Tissue Products Having Reduced Slough.

U.S. Appl. No. 10/289,129, filed Nov. 6, 2002, Garnier, et al., Tissue Products Having Reduced Lint And Slough.

PCT International Search Report, International Application No. PCT/US03/27314, International Filing Date Aug. 29, 2003.

*Primary Examiner*—José A. Fortuna
(74) *Attorney, Agent, or Firm*—Dority & Manning, P.A.

(57) ABSTRACT

A tissue product containing a multi-layered paper web that has at least one outer layer formed from a blend of pulp fibers and synthetic fibers is provided. A polymer latex is also applied to the outer layer of the tissue product. It is believed that the polymer latex and synthetic fibers can fuse together to have a synergistic effect on the strength of the tissue product. In addition, the resulting tissue product can be soft and produce low levels of lint and slough.

46 Claims, 3 Drawing Sheets

U.S. PATENT DOCUMENTS 5,129,988 A 7/1992 Farrington, Jr.
5,162,074 A 11/1992 Hills
5,164,046 A 11/1992 Ampulski et al.
5,167,765 A 12/1992 Nielsen et al.
5,238,534 A 8/1993 Manning et al.
5,240,562 A 8/1993 Phan et al.
5,277,976 A 1/1994 Hogle et al.
5,336,552 A 8/1994 Strack et al.
5,382,400 A 1/1995 Pike et al.
5,385,643 A 1/1995 Ampulski
5,397,435 A 3/1995 Ostendorf et al.
5,399,412 A 3/1995 Sudall et al.
5,405,501 A 4/1995 Phan et al.
5,409,768 A 4/1995 Dickenson et al.
5,427,696 A 6/1995 Phan et al.
5,437,766 A 8/1995 Van Phan et al.
5,466,337 A 11/1995 Darlington et al.
5,466,410 A 11/1995 Hills
5,494,554 A 2/1996 Edwards et al.
5,510,000 A 4/1996 Phan et al.
5,510,001 A 4/1996 Hermans et al.
5,529,665 A 6/1996 Kaun
5,543,067 A 8/1996 Phan et al.
5,558,873 A 9/1996 Funk et al.
5,591,309 A 1/1997 Rugowski et al.
5,667,636 A 9/1997 Engel et al.
5,716,498 A 2/1998 Jenny et al.
5,730,839 A 3/1998 Wendt et al.
5,846,380 A 12/1998 Van Phan et al.
5,851,352 A 12/1998 Vinson et al.
5,853,539 A 12/1998 Smith et al.
5,885,418 A * 3/1999 Anderson et al. ..... 162/112
5,935,383 A 8/1999 Sun et al.
5,981,044 A 11/1999 Phan et al.
5,981,410 A 11/1999 Hansen et al.
5,985,434 A 11/1999 Qin et al.
5,989,682 A 11/1999 Anderson
5,993,602 A 11/1999 Smith et al.
6,017,417 A 1/2000 Wendt et al.
6,017,418 A 1/2000 Oriaran et al.
6,096,152 A 8/2000 Anderson et al.
6,129,815 A * 10/2000 Larson et al. ..... 162/112
6,200,669 B1 3/2001 Marmon et al.
6,211,139 B1 4/2001 Keys et al.
6,231,719 B1 5/2001 Garvey et al.
6,241,850 B1 6/2001 Kelly
6,248,211 B1 6/2001 Jennings et al.
6,248,212 B1 * 6/2001 Anderson et al. ..... 162/112
6,261,580 B1 7/2001 Lehrter et al.
6,277,241 B1 8/2001 Merker et al.
6,315,864 B2 * 11/2001 Anderson et al. ..... 162/109
6,328,850 B1 12/2001 Phan et al.
6,368,609 B1 4/2002 Fontenot et al.
6,387,495 B1 5/2002 Reeves et al.
6,423,180 B1 * 7/2002 Behnke et al. ..... 162/112
6,432,270 B1 8/2002 Liu et al.
6,500,289 B2 * 12/2002 Merker et al. ..... 156/183
6,534,151 B2 * 3/2003 Merker ..... 428/154
2002/0084048 A1 * 7/2002 Merker et al. ..... 162/123
2002/0088592 A1 7/2002 Drew et al.
2002/0134520 A1 * 9/2002 Behnke et al. ..... 162/100
2003/0131962 A1 * 7/2003 Lindsay et al. ..... 162/168.2

* cited by examiner

TISSUE PRODUCTS HAVING ENHANCED STRENGTH

BACKGROUND OF THE INVENTION

Tissue products, such as facial tissues, paper towels, bath tissues, sanitary napkins, and other similar products, are designed to include several important properties. For example, the products should have good durability when wet, a soft feel, and should be absorbent. Unfortunately, however, when steps are taken to increase one property of the product, other characteristics of the product are often adversely affected. For example, during a papermaking process, it is common to use various resins to increase the wet strength of the web. Cationic resins, for example, are often used because they are believed to more readily bond to the anionically charged cellulosic fibers. Although strength resins can increase the strength of the web, they also tend to stiffen the web, which is often undesired by consumers. Thus, to counteract this stiffness, chemical debonders are commonly utilized to reduce fiber bonding.

Nevertheless, reducing fiber bonding can sometimes result in a substantial reduction in the wet-to-dry strength ratio of the tissue product. For example, ideally, the wet-to-dry strength ratio of a tissue product in the cross-direction, the weakest direction of the tissue product, would approximate 1.0 so that the strength of the tissue product is not substantially different when wet or dry. Unfortunately, however, the wet-to-dry strength ratio of most conventional tissue products is in the range of about 0.05 to about 0.15. Such a low wet-to-dry strength ratio means that the strength of the tissue product substantially decreases when the tissue product is wet. This is clearly undesired, particularly when the tissue product is used as a paper towel, for example, to absorb liquids. In addition, a debonded tissue product can sometimes possess individual airborne fibers and fiber fragments (i.e., lint) and zones of fibers that are poorly bound to each other but not to adjacent zones of fibers (i.e., slough). During use, certain shear forces can liberate the weakly bound zones from the remaining fibers, thereby resulting in slough, i.e., bundles or pills on surfaces, such as skin or fabric.

Thus, a need still exists for a soft tissue product that has good wet strength and produces low levels of lint and slough.

SUMMARY OF THE INVENTION

In accordance with one embodiment of the present invention, a tissue product is disclosed that comprises a multi-layered paper web having at least one outer layer that defines an outer surface of the tissue product. The outer layer comprises a blend of pulp fibers and synthetic fibers in an amount from about 0.1% to about 25% by weight of the layer so that the total amount of synthetic fibers present within the web is from about 0.1% to about 20% by weight. The outer layer is applied with a polymer latex. The polymer latex may have a glass transition temperature of from about −25° C. to about 30° C. For example, in some embodiments, the polymer latex is selected from the group consisting of styrene-butadiene copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, and nitrile polymers. In some embodiments, the polymer latex comprises about 10% or less of the dry weight of the web, and in some embodiments, from about 0.1% to about 7% of the dry weight of the web.

In accordance with another embodiment of the present invention, a single-ply tissue product is disclosed that comprises an inner layer positioned between a first outer layer and a second outer layer. The inner layer and outer layers comprise pulp fibers, and the first outer layer further comprises synthetic fibers in an amount from about 0.1% to about 20% by weight of the layer so that the total amount of synthetic fibers present within the tissue product is from about 0.1% to about 20% by weight. The first outer layer is applied with a polymer latex in an amount of from about 0.1% to about 10% of the dry weight of the web.

In accordance with another embodiment of the present invention, a multi-ply tissue product is disclosed that comprises a first ply and second ply. The first ply comprises a first layer defining an outer surface of the tissue product. The first layer comprises a blend of pulp fibers and synthetic fibers in an amount from about 0.1% to about 20% by weight of the layer so that the total amount of synthetic fibers present within the web is from about 0.1% to about 20% by weight. The first layer is applied with a polymer latex in an amount of from about 0.1% to about 10% of the dry weight of the ply.

In accordance with still another embodiment of the present invention, a method for forming a tissue product is disclosed that comprises forming a multi-layered paper web that includes at least one outer layer. The outer layer comprises a blend of pulp fibers and synthetic fibers in an amount from about 0.1% to about 25% by weight of the layer so that the total amount of synthetic fibers present within the web is from about 0.1% to about 20% by weight. The method further comprises drying the multi-layered paper web and applying a polymer latex to the outer layer. The latex may or may not be cured. The web may be dried at a temperature that is greater than, equal to, or less than the melting point of one or more components of the synthetic fibers.

A tissue product formed according to the present invention can be durable, i.e., have improved wet strength. For example, the tissue product may exhibit a wet-to-dry tensile strength ratio in the cross-direction of about 0.20 or more, in some embodiments about 0.30 or more, and in some embodiments, about 0.40 or more. It is believed that such improved strength is achieved through the synergistic combination of synthetic fibers and polymer latex treatment. In addition, besides exhibiting improved strength, the tissue product of the present invention may also produce relatively low levels of lint and slough.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
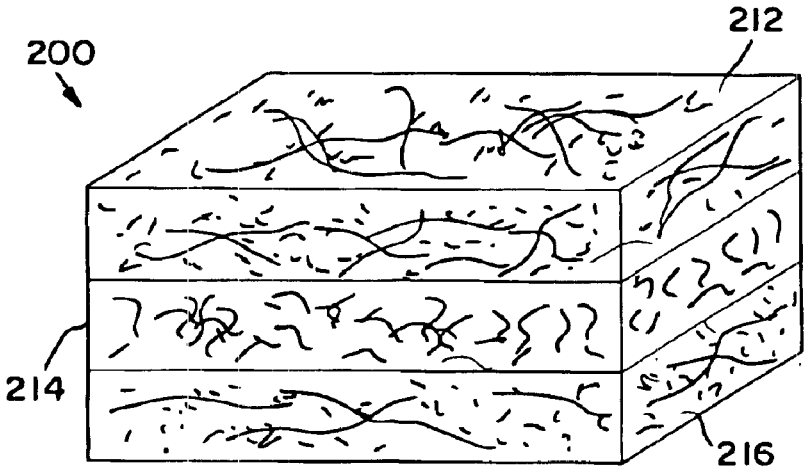
FIG. 1 illustrates one embodiment of a single ply tissue product formed according to the present invention.

Repeat use of reference characters in the present specification and drawings is intended to represent same or analogous features or elements of the present invention.

DETAILED DESCRIPTION OF REPRESENTATIVE EMBODIMENTS

Definitions

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of about 1.5 millimeters or less as determined by an optical fiber analyzer such as, for example, a Kajaani fiber analyzer Model No. FS-100 (Kajaani Oy Electronics, Kajaani, Finland). For example, low average fiber length pulps may have an average fiber length ranging from about 0.7 to about 1.2 millimeters. Exemplary low average fiber length pulps include virgin hardwood pulp, and secondary fiber pulp from sources such as, for example, office waste, newsprint, and paperboard scrap.

As used herein, the term "high-average fiber length pulp" refers to pulp that contains a relatively small amount of short fibers and non-fiber particles. High-average fiber length pulp is typically formed from certain non-secondary (i.e., virgin) fibers. Secondary fiber pulp that has been screened may also have a high-average fiber length. High-average fiber length pulps typically have an average fiber length of greater than about 1.5 millimeters as determined by an optical fiber analyzer such as, for example, a Kajaani fiber analyzer Model No. FS-100 (Kajaani Electronics, Kajaani, Finland). For example, a high-average fiber length pulp may have an average fiber length from about 1.5 millimeters to about 6 millimeters. Exemplary high-average fiber length pulps that are wood fiber pulps include, for example, bleached and unbleached virgin softwood fiber pulps.

As used herein, a "tissue product" generally refers to various paper products, such as facial tissue, bath tissue, paper towels, napkins, and the like. Normally, the basis weight of a tissue product of the present invention is about 120 grams per square meter (gsm) or less, in some embodiments about 60 grams per square meter or less, and in some embodiments, from about 10 to about 60 gsm.

Detailed Description

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a tissue product containing a multi-layered paper web that has at least one outer layer formed from a blend of pulp fibers and synthetic fibers. A polymer latex is also applied to the outer layer of the tissue product. It is believed that the polymer latex and synthetic fibers can fuse together to have a synergistic effect on the wet strength of the tissue product. In addition, the resulting tissue product can be soft and produce low levels of lint and slough.

As indicated, the tissue product of the present invention contains at least one multi-layered paper web. The tissue product can be a single-ply tissue product in which the web forming the tissue is stratified, i.e., has multiple layers, or a multi-ply tissue product in which the webs forming the multi-ply tissue product may themselves be either single or multi-layered. However, it should be understood that the tissue product can include any number of plies or layers and can be made from various types of fibers.

Regardless of the exact construction of the tissue product, one or more layers of the multi-layered paper web incorporated into the tissue product are formed with pulp fibers. The pulp fibers may include fibers formed by a variety of pulping processes, such as kraft pulp, sulfite pulp, thermomechanical pulp, etc. Further, the pulp fibers may have any high-average fiber length pulp, low-average fiber length pulp, or mixtures of the same. One example of suitable high-average length pulp fibers include softwood fibers such as, but not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19". One example of suitable low-average length fibers include hardwood fibers, such as, but not limited to, eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Other suitable pulp fibers include thermomechanical pulp fibers, chemithermomechanical pulp fibers, bleached chemithermomechanical pulp fibers, chemimechanical pulp fibers, refiner mechanical pulp (RMP) fibers, stone groundwood (SGW) pulp fibers, and peroxide mechanical pulp (PMP) fibers. Thermomechanical pulp (TMP) fibers are produced by steaming wood chips at elevated temperature and pressure to soften the lignin in the wood chips. Steaming the wood softens the lignin so that fiber separation occurs preferentially in the highly lignified middle lamella between the fibers, facilitating the production of longer, less damaged fibers. Moreover, if desired, secondary fibers obtained from recycled materials may be used, such as fiber pulp from sources such as, for example, newsprint, reclaimed paperboard, and office waste.

In addition, synthetic fibers are also blended with the pulp fibers in at least one layer of the paper web to increase the strength of the tissue product. Some suitable polymers that may be used to form the synthetic fibers include, but are not limited to, polyolefins, e.g., polyethylene, polypropylene, polybutylene, and the like; polytetrafluoroethylene; polyesters, e.g., polyethylene terephthalate and the like; polyvinyl acetate; polyvinyl chloride acetate; polyvinyl butyral; acrylic resins, e.g., polyacrylate, polymethylacrylate, polymethylmethacrylate, and the like; polyamides, e.g., nylon; polyvinyl chloride; polyvinylidene chloride; polystyrene; polyvinyl alcohol; polyurethanes; polylactic acid; and the like. If desired, biodegradable polymers, such as poly(glycolic acid) (PGA), poly(lactic acid) (PLA), poly(β-malic acid) (PMLA), poly(ε-caprolactone) (PCL), poly(ρ-dioxanone) (PDS), and poly(3-hydroxybutyrate) (PHB), may also be utilized. The polymer (s) used to form the synthetic fibers may also include synthetic and/or natural cellulosic polymers, such as cellulosic esters, cellulosic ethers, cellulosic nitrates, cellulosic acetates, cellulosic acetate butyrates, ethyl cellulose, regenerate celluloses (e.g., viscose, rayon, etc.).

In one particular embodiment, the synthetic fibers are multicomponent fibers. Multicomponent fibers are fibers that have been formed from two or more thermoplastic polymers and that may be extruded from separate extruders, but spun together, to form one fiber. Multicomponent fibers may have a side-by-side arrangement, a sheath/core arrangement (e.g., eccentric and concentric), a pie wedge arrangement, a hollow pie wedge arrangement, island-in-the-sea, three island, bull's eye, or various other arrangements known in the art. In a sheath/core bicomponent fiber, for instance, a first polymer component is surrounded by a second polymer component. The polymers of these bicomponent fibers are arranged in substantially constantly positioned distinct zones across the cross-section of the bicomponent fiber and extend continuously along the length of the fibers. Multicomponent fibers and methods of making the same are taught in U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. The fibers and individual components containing the same may also have various irregular shapes such as those described in U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

Although any combination of polymers may be used to form the multicomponent fibers, the polymers of the multicomponent fibers are typically made from thermoplastic materials with different glass transition or melting temperatures, such as for example, polyolefin/polyester (sheath/core) or polyester/polyester multicomponent fibers where the sheath melts at a temperature lower than the core. Softening or melting of the first polymer component of the multicomponent fiber allows the multicomponent fibers to form a tacky skeletal structure, which upon cooling, captures and binds many of the pulp fibers. For example, the multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer. One commercially available example of a bicomponent fiber that may be used in the present invention is AL-Adhesion-C, a polyethylene/polypropylene sheath/core fiber available from ES Fibervision, Inc. of Athens, Ga. Another commercially example of a suitable bicomponent fiber is Celbond® Type 105, a polyethylene/polyester sheath/core fiber available from Kosa, inc. of Salisbury, N.C. Other suitable commercially available bicomponent fibers include polyethylene and polypropylene synthetic pulp fibers available from Minifibers, Inc. of Johnson City, Tenn.

When utilized, the synthetic fibers can soften and fuse to themselves and the pulp fibers upon heating (e.g., thermofusing), thereby creating a continuous or semi-continuous network within the layer of the web. This network can help increase the strength of the tissue product, even when wet, and also prevent zones of cellulosic fibers from being removed from the web layer as lint or slough. In addition, due to their relatively long nature, the synthetic fibers may also entangle with the pulp fibers, thereby further increasing strength and inhibiting the removal of the pulp fibers as lint or slough. For instance, the synthetic fibers typically have a length of from about 0.5 to about 30 millimeters, in some embodiments from about 4 to about 12 millimeters, and in some embodiments, from about 4 to about 8 millimeters. In addition, the synthetic fibers may have a denier of from about 0.5 to about 10, in some embodiments from about 1 to about 5, and in some embodiments, from about 1 to about 3.

Further, the synthetic fibers may also be selected to have a "density imbalance" within a predetermined range. "Density imbalance" is defined as the density of water minus the density of the fibers ($\Delta\rho=\rho_{water}-\rho_{fibers}$). If the density imbalance is too high (e.g., positive), the fibers tend to float in water during the papermaking process so that a counter-acting fiber surface treatment is required to "sink" the fibers to a desired extent into the cellulosic fibrous furnish for uniform mixing therewith. If the density imbalance is too low, the fibers tend to sink in water during the papermaking process so that a counter-acting fiber surface treatment is required to "raise" the fibers to a desired extent for uniform mixing with the cellulosic fibrous furnish. Thus, although not required, the density of the synthetic fibers typically remains close to the density of water so that the density imbalance is from about −0.2 to about +0.5 grams per cubic centimeter (g/cm$^3$), in some embodiments from about −0.2 to about +0.4 g/cm$^3$, and in some embodiments, from about −0.1 to about +0.4 g/cm$^3$, to facilitate processing of the paper web.

The amount of the synthetic fibers present within a layer of the multi-layered paper web may generally vary depending on the desired properties of the tissue product. For instance, the use of a large amount of synthetic fibers typically results in a tissue product that is strong and has very little lint and slough, but that is also relatively costly and more hydrophobic. Likewise, the use of a low amount of synthetic fibers typically results in a tissue product that is inexpensive and very hydrophilic, but that is also weaker and generates a higher amount of lint and slough. Thus, the synthetic fibers typically constitute from about 0.1% to about 25%, in some embodiments from about 0.1% to about 20%, in some embodiments from about 0.1% to about 10%, in some embodiments from about 2% to about 8%, and in some embodiments, from about 2% to about 5% of the dry weight of fibrous material synthetic fibers of a given layer. Further, in some embodiments, the synthetic fibers typically constitute from about 0.1% to about 20%, in some embodiments from about 0.1% to about 10%, in some embodiments from about 0.1% to about 5%, and in some embodiments, from about 0.1% to about 2% of the dry weight of the entire web.

The properties of the resulting tissue product may be varied by selecting particular layer(s) for incorporation of the synthetic fibers. For example, the increase in web hydrophobicity and cost sometimes encountered with synthetic fibers can be reduced by restricting application of the synthetic fibers to only the outer layer(s) of the web. For instance, in one embodiment, a three-layered paper web can be formed in which each outer layer contains pulp fiber and synthetic fibers, while the inner layer is substantially free of synthetic fibers. It should be understood that, when referring to a layer that is substantially free of synthetic fibers, minuscule amounts of the fibers may be present therein. However, such small amounts often arise from the synthetic fibers applied to an adjacent layer, and do not typically substantially affect the hydropobicity of the tissue product.

As indicated above, the synthetic fibers are generally blended with pulp fibers and incorporated into one or more layers of a multi-layered paper web. For instance, as shown in FIG. 1, one embodiment of the present invention includes the formation of a single ply tissue product 200. In this embodiment, the single ply is a paper web having three layers 212, 214, and 216. The outer layers 212 and/or 216 may contain synthetic fibers, such as described above. For example, in one embodiment, both outer layers 212 and 216 contain a blend of about 95% softwood fibers and about 5% synthetic fibers, such that the total fiber content of the layer 212 represents about 25% by weight of the tissue product 200 and the total fibers content of the layer 216 represents about 25% by weight of the tissue product 200. In addition, the inner layer 214 includes about 50% softwood fibers and 50% bleached chemithermomechanical pulp fibers such that the total fiber content of the layer 214 represents about 50% by weight of the tissue product 200.

Figure 2:
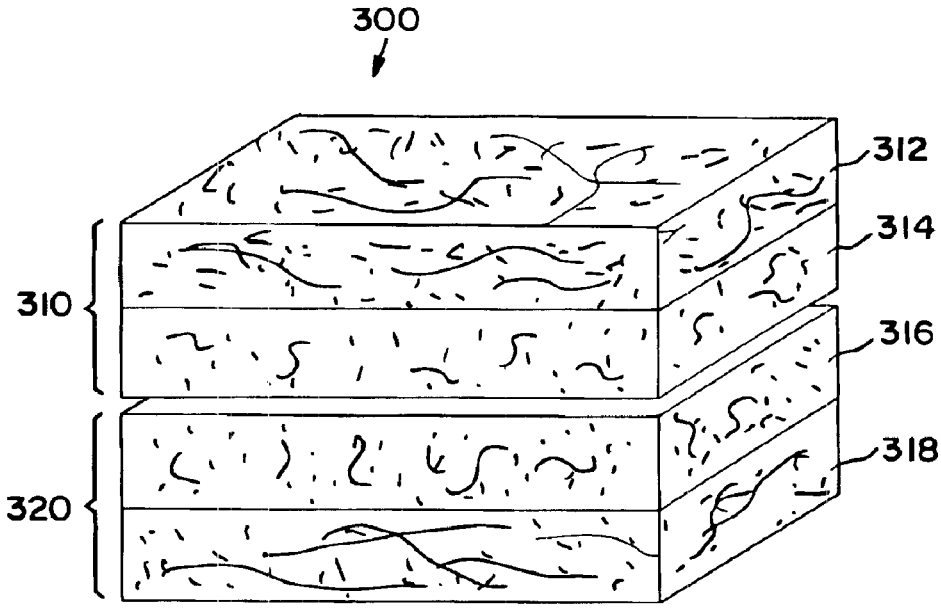
FIG. 2 illustrates one embodiment of a two ply tissue product formed according to the present invention.

Referring to FIG. 2, one embodiment of a two-ply tissue product 300 is shown. In this embodiment, the tissue product 300 contains an upper multi-layered paper web 310 and a lower multi-layered paper web 320 that are plied together using well-known techniques. The upper web 310 contains two layers 312 and 314. For example, in one embodiment, the layer 312 contains a blend of about 95% hardwood fibers and about 5% synthetic fibers, such that the total fiber content of the layer 312 represents about 35% by weight of web 310. In addition, the layer 314 contains about 50% hardwood fibers and about 50% softwood fibers and represents about 65% by weight of the web 310. The lower paper web 320 contains a layer 316 of about 50% hardwood fibers and 50% softwood fibers and a layer 318 of about 95% hardwood fibers and about 5% synthetic fibers, constituting about 65% and about 35% of the web 320, respectively.

In accordance with the present invention, a polymer latex is also applied to one or more layers of the tissue product to further increase strength and reduce lint and slough in the resulting tissue product. Without being limited in theory, it is believed that, when applied, the polymer latex can fuse to the synthetic fibers present in the corresponding layer. As a result, a network can be formed by the synthetic fibers and the polymer latex to enhance the strength of the tissue product, even when wet. This network may also inhibit the generation of lint and slough. The polymer suitable for use in the lattices typically has a glass transition temperature of about 30° C. or less so that the flexibility of the resulting web is not substantially restricted. Moreover, the polymer also typically have a glass transition temperature of about −25° C. or more to minimize the tackiness of the polymer latex. For instance, in some embodiments, the polymer has a glass transition temperature from about −15° C. to about 15° C., and in some embodiments, from about −10° C. to about 0° C.

Although not required, the polymer lattices used in the present invention are typically nonionic or anionic to facilitate application to the paper web. For instance, some suitable polymer lattices that can be utilized in the present invention may be based on polymers such as, but are not limited to, anionic styrene-butadiene copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, nitrile polymers, and any other suitable anionic polymer latex polymers known in the art. The charge (e.g., anionic or nonionic) of the polymer lattices described above can be readily varied, as is well known in the art, by utilizing a stabilizing agent having the desired charge during preparation of the polymer latex. Other examples of suitable polymer lattices may be described in U.S. Pat. No. 3,844,880 to Meisel, Jr., et al., which is incorporated herein in its entirety by reference thereto for all purposes.

To minimize the stiffness of the tissue product, the polymer latex can be applied in relatively small amounts. In some embodiments, the polymer latex is applied in an amount of about 10% or less, in some embodiments from about 0.1% to about 7%, and in some embodiments, from about 0.5% to about 2% of the dry weight of the fibrous material within the web. Further, the stiffness of the web can also be reduced by restricting application of the polymer latex to only the outer layer(s) of the web. For instance, in one embodiment, a single ply tissue product can contain a three-layered paper web in which the outer layers contain the polymer latex, while the inner layer is substantially free of the polymer latex. It should be understood that, when referring to a layer that is substantially free of the polymer latex, minuscule amounts of polymer latex may be present therein. However, such small amounts often arise from the polymer latex applied to the outer layer, and do not typically substantially affect the stiffness of the tissue product.

If desired, various other chemical compositions may be applied to one or more layers of the multi-layered paper web to further enhance the strength and softness of the tissue product. For example, in some embodiments, a conventional wet strength agent can be utilized to further increase the strength of the tissue product. Conventional wet strength agents are typically deemed either "permanent" or "temporary." As is well known in the art, temporary and permanent wet strength agents may also sometimes function as dry strength agents to enhance the strength of the tissue product when dry. Wet strength agents may be applied in various amounts, depending on the desired characteristics of the web.

Suitable permanent wet strength agents are typically water soluble, cationic oligomeric or polymeric resins that are capable of either crosslinking with themselves (homocrosslinking) or with the cellulose or other constituents of the wood fiber. Examples of such compounds are described in U.S. Pat. Nos. 2,345,543; 2,926,116; and 2,926,154, which are incorporated herein in their entirety by reference thereto for all purposes. One class of such agents includes polyamine-epichlorohydrin, polyamide epichlorohydrin or polyamide-amine epichlorohydrin resins, collectively termed "PAE resins". Examples of these materials are described in U.S. Pat. No. 3,700,623 to Keim and U.S. Pat. No. 3,772,076 to Keim, which are incorporated herein in their entirety by reference thereto for all purposes and are sold by Hercules, Inc., Wilmington, Del. under the trade designation "Kymene", e.g., Kymene 557H or 557 LX. Kymene 557 LX, for example, is a polyamide epicholorohydrin polymer that contains both cationic sites, which can form ionic bonds with anionic groups on the pulp fibers, and azetidinium groups, which can form covalent bonds with carboxyl groups on the pulp fibers and crosslink with the polymer backbone when cured.

Other suitable materials include base-activated polyamide-epichlorohydrin resins, which are described in U.S. Pat. No. 3,885,158 to Petrovich; U.S. Pat. No. 3,899,388 to Petrovich; U.S. Pat. No. 4,129,528 to Petrovich; U.S.

Pat. No. 4,147,586 to Petrovich; and U.S. Pat. No. 4,222,921 to van Eanam, which are incorporated herein in their entirety by reference thereto for all purposes. Polyethylenimine resins may also be suitable for immobilizing fiber-fiber bonds. Another class of permanent-type wet strength agents includes aminoplast resins (e.g., urea-formaldehyde and melamine-formaldehyde). If utilized, the permanent wet strength agents can be added in an amount between about 1 lb/T to about 20 lb/T, in some embodiments, between about 2 lb/T to about 10 lb/T, and in some embodiments, between about 3 lb/T to about 6 lb/T of the dry weight of fibrous material.

Suitable temporary wet strength agents can be selected from agents known in the art such as dialdehyde starch, polyethylene imine, mannogalactan gum, glyoxal, and dialdehyde mannogalactan. Also useful are glyoxylated vinylamide wet strength resins as described in U.S. Pat. No. 5,466,337 to Darlington, et al., which is incorporated herein in its entirety by reference thereto for all purposes. Useful water-soluble resins include polyacrylamide resins such as those sold under the Parez trademark, such as Parez 631NC, by Cytec Industries, Inc. of Stanford, Conn. Such resins are generally described in U.S. Pat. No. 3,556,932 to Coscia, et al. and U.S. Pat. No. 3,556,933 to Williams, et al., which are incorporated herein in their entirety by reference thereto for all purposes. For example, the "Parez" resins typically include a polyacrylamide-glyoxal polymer that contains cationic hemiacetal sites that can form ionic bonds with carboxyl or hydroxyl groups present on the cellulosic fibers. These bonds can provide increased strength to the web of pulp fibers. In addition, because the hemicetal groups are readily hydrolyzed, the wet strength provided by such resins is primarily temporary. U.S. Pat. No. 4,605,702 to Guerro, et al., which is incorporated herein in its entirety by reference thereto for all purposes, also describes suitable temporary wet strength resins made by reacting a vinylamide polymer with glyoxal, and then subjecting the polymer to an aqueous base treatment. Similar resins are also described in U.S. Pat. No. 4,603,176 to Bjorkquist, et al.; U.S. Pat. No. 5,935,383 to Sun, et al.; and U.S. Pat. No. 6,017,417 to Wendt, et al., which are incorporated herein in their entirety by reference thereto for all purposes.

When utilized, the total amount of wet strength agents is typically from between about 1 pound per ton (lb/T) to about 60 lb/T, in some embodiments, from about 5 lb/T to about 30 lb/T, and in some embodiments, from about 7 lb/T to about 13 lb/T of the dry weight of fibrous material. The wet strength agents can be incorporated into any layer of the multi-layered paper web. Further, when utilized, the temporary wet strength agents are generally provided by the manufacturer as an aqueous solution and, in some embodiments, are typically added in an amount of from about 1 lb/T to about 60 lb/T, in some embodiments, from about 3 lb/T to about 40 lb/T, and in some embodiments, from about 4 lb/T to about 15 lb/T of the dry weight of fibrous material. If desired, the pH of the fibers can be adjusted prior to adding the resin. The Parez resins, for example, are typically used at a pH of from about 4 to about 8.

A chemical debonder can also be applied to soften the web by reducing the amount of hydrogen bonds within one or more layers of the web. In fact, as a result of the present invention, it has been discovered that debonders may be utilized for softening without substantially reducing the wet strength of the tissue product. Depending on the desired characteristics of the resulting tissue product, the debonder can be utilized in varying amounts. For example, in some embodiments, the debonder can be applied in an amount in an amount from about 1 lb/T to about 30 lb/T, in some embodiments from about 3 lb/T to about 20 lb/T, and in some embodiments, from about 6 lb/T to about 15 lb/T of the dry weight of fibrous material. The debonder can be incorporated into any layer of the multi-layered paper web.

Any material that can be applied to fibers and that is capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty & carboxylic acid derivatives, mono- and polysaccharide derivatives, polyhydroxy hydrocarbons, etc. For instance, some suitable debonders are described in U.S. Pat. No. 5,716,498 to Jenny, et al.; U.S. Pat. No. 5,730,839 to Wendt, et al.; U.S. Pat. No. 6,211,139 to Keys, et al.; U.S. Pat. No. 5,543,067 to Phan, et al.; and WO/0021918, which are incorporated herein in their entirety by reference thereto for all purposes. For instance, Jenny, et al. and Phan, et al. describe various ester-functional quaternary ammonium debonders (e.g., quaternized fatty acid trialkanolamine ester salts) suitable for use in the present invention. In addition, Wendt, et al. describes imidazolinium quaternary debonders that may be suitable for use in the present invention. Further, Keys, et al. describes polyester polyquaternary ammonium debonders that may be useful in the present invention. Still other suitable debonders are disclosed in U.S. Pat. No. 5,529,665 to Kaun and U.S. Pat. No. 5,558,873 to Funk, et al., which are incorporated herein in their entirety by reference thereto for all purposes. In particular, Kaun discloses the use of various cationic silicone compositions as softening agents.

The multi-layered web can generally be formed according to a variety of papermaking processes known in the art. In fact, any process capable of making a paper web can be utilized in the present invention. For example, a papermaking process of the present invention can utilize wet-pressing, creping, through-air-drying, creped through-air-drying, uncreped through-air-drying, single recreping, double recreping, calendering, embossing, air laying, as well as other steps in processing the paper web. In some embodiments, in addition to the use of various chemical treatments, such as described above, the papermaking process itself can also be selectively varied to achieve a web with certain properties. For instance, a papermaking process can be utilized to form a multi-layered paper web, such as described and disclosed in U.S. Pat. No. 5,129,988 to Farrington, Jr.; U.S. Pat. No. 5,494,554 to Edwards, et al.; and U.S. Pat. No. 5,529,665 to Kaun, which are incorporated herein in their entirety by reference thereto for all purposes.

One particular embodiment of the present invention utilizes an uncreped through-drying technique to form the tissue. Through-air drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; U.S. Pat. No. 6,017,417 to Wendt, et al., and U.S. Pat. No.

6,432,270 to Liu, et al., which are incorporated herein in their entirety by reference thereto for all purposes. Uncreped through-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

Figure 3:
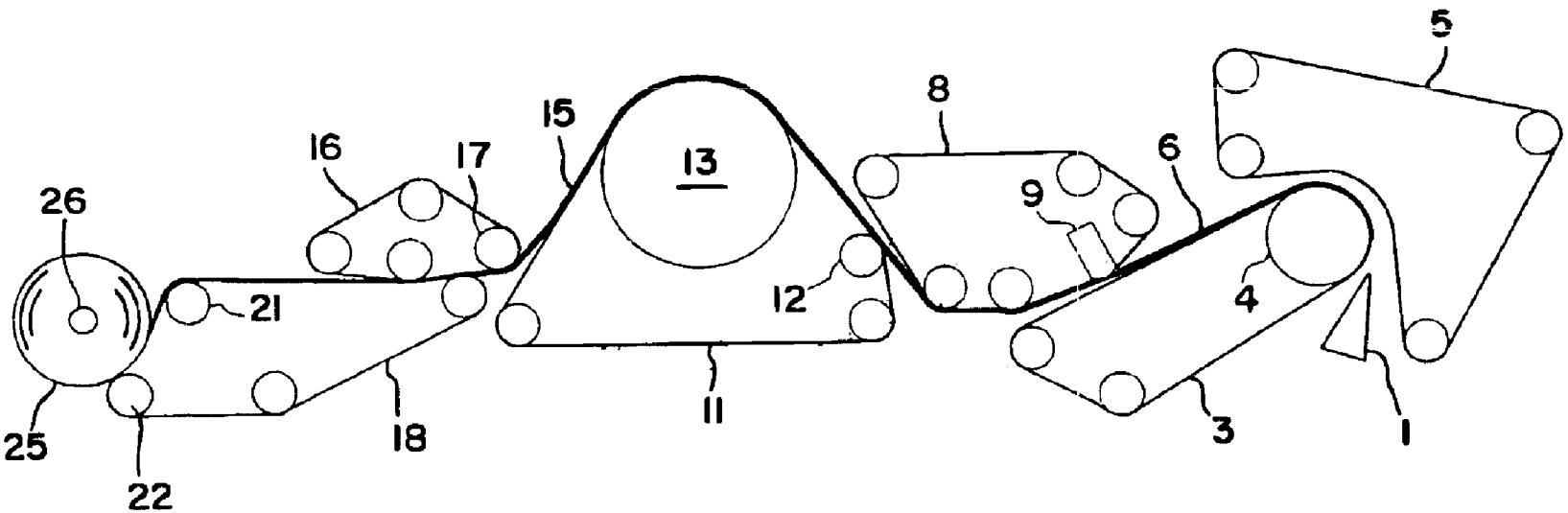
FIG. 3 is a schematic flow diagram of one embodiment of a papermaking process that can be used in the present invention.

For example, referring to FIG. 3, one embodiment of a papermaking machine that can be used in forming an uncreped through-dried tissue product is illustrated. For simplicity, the various tensioning rolls schematically used to define the several fabric runs are shown but not numbered. As shown, a papermaking headbox 1 can be used to inject or deposit a stream of an aqueous suspension of papermaking fibers onto an inner forming fabric 3 as it transverses the forming roll 4. An outer forming fabric 5 serves to contain the web 6 while it passes over the forming roll 4 and sheds some of the water. If desired, dewatering of the wet web 6 can be carried out, such as by vacuum suction, while the wet web 6 is supported by the forming fabric 3.

The wet web 6 is then transferred from the forming fabric 3 to a transfer fabric 8 while at a solids consistency of from about 10% to about 35%, and particularly, from about 20% to about 30%. As used herein, a "transfer fabric" is a fabric that is positioned between the forming section and the drying section of the web manufacturing process. The transfer fabric 8 may be a patterned fabric having protrusions or impression knuckles, such as described in U.S. Pat. No. 6,017,417 to Wendt et al. Typically, the transfer fabric 8 travels at a slower speed than the forming fabric 3 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes.

Transfer to the fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies pressure at levels from about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

From the transfer fabric 8, the fibrous web 6 is then transferred to the through-drying fabric 11 with the aid of a vacuum transfer roll 12. When the wet web 6 is transferred to the fabric 11. While supported by the through-drying fabric 11, the web 6 is then dried by a through-dryer 13 to a solids consistency of about 90% or greater, and in some embodiments, about 95% or greater. The through-dryer 13 accomplishes the removal of moisture by passing air through the web without applying any mechanical pressure. Through-drying can also increase the bulk and softness of the web. In one embodiment, for example, the through-dryer 13 can contain a rotatable, perforated cylinder and a hood for receiving hot air blown through perforations of the cylinder as the through-drying fabric 11 carries the web 6 over the upper portion of the cylinder. The heated air is forced through the perforations in the cylinder of the through-dryer 13 and removes the remaining water from the web 6. The temperature of the air forced through the web 6 by the through-dryer 13 can vary, but is typically from about 100° C. to about 250° C. There can be more than one through-dryer in series (not shown), depending on the speed and the dryer capacity. It should also be understood that other non-compressive drying methods, such as microwave or infrared heating, can be used. Further, compressive drying methods, such as drying with the use of a Yankee dryer, may also be used in the present invention.

The dried tissue sheet 15 is then transferred to a first dry end transfer fabric 16 with the aid of vacuum transfer roll 17. The tissue sheet shortly after transfer is sandwiched between the first dry end transfer fabric 16 and a transfer belt 18 to positively control the sheet path. The air permeability of the transfer belt 18 may be lower than that of the first dry end transfer fabric 16, causing the sheet to naturally adhere to the transfer belt 18. At the point of separation, the sheet 15 follows the transfer belt 18 due to vacuum action. Suitable low air permeability fabrics for use as the transfer belt 18 include, without limitation, COFPA Mononap NP 50 dryer felt (air permeability of about 50 cubic feet per minute per square foot) and Asten 960C (impermeable to air). The transfer belt 18 passes over two winding drums 21 and 22 before returning to again pick up the dried tissue sheet 15. The sheet 15 is transferred to a parent roll 25 at a point between the two winding drums. The parent roll 25 is wound onto a reel spool 26, which is driven by a center drive motor.

In accordance with the present invention, it may sometimes be desired to select a certain drying temperature of the web (e.g., temperature of Yankee or through-air dryer) to control the degree of bonding between the synthetic fibers of the outer layer. For example, in some embodiments, the drying temperature may be less than the melting or softening point of one or more components of the synthetic fibers. In other embodiments, it may be desired to impart a greater level of bonding between adjacent synthetic fibers. Thus, the drying temperature can simply be increased to become close to or surpass the melting point of one or more components of the synthetic fibers. For example, in one particular embodiment, a web containing polyethylene/polyester (PE/PET) bicomponent fibers is dried with a through-air dryer at 280° F. The polyethylene has a melting or softening point of 279° F. and the polyester has a melting or softening point of 518° F. Thus, the PE/PET component of the synthetic fibers become softened and bond to adjacent synthetic fibers at their crossover points and to the pulp fibers. Such bonding can further increase the strength of the web, and also form a "network" that inhibits the generation of slough and lint in the resulting tissue product. Although control of the drying temperature is one technique for bonding the synthetic fibers, it should also be understood that other techniques may also be utilized in the present invention. For example, in some embodiments, the fibers may be heated to their bonding temperature after substantial drying has already occurred.

The polymer latex may be applied before, during, and/or after the web 15 is dried. One particularly beneficial method is to apply the polymer latex to the surface of the web using rotogravure or gravure printing, either direct or indirect (offset). Gravure printing encompasses several well-known engraving techniques, such as mechanical engraving, acid-etch engraving, electronic engraving and ceramic laser engraving. Such printing techniques provide excellent control of the composition distribution and transfer rate. Gravure printing may provide, for example, from about 10 to about 1000 deposits per lineal inch of surface, or from about 100 to about 1,000,000 deposits per square inch. Each deposit results from an individual cell on a printing roll, so that the density of the deposits corresponds to the density of the cells. A suitable electronic engraved example for a primary delivery zone is about 200 deposits per lineal inch of surface, or about 40,000 deposits per square inch. By providing such a large number of small deposits, the uniformity of the deposit distribution may be enhanced. Also, because of the large number of small deposits applied to the surface of the web, the deposits more readily resolidify on the surface where they are most effective in reducing slough. As a consequence, a relatively low amount of the polymer latex can be used to cover a large area. Suitable gravure printing techniques are also described in U.S. Pat. No. 6,231,719 to Garvey, et al., which is incorporated herein in its entirety by reference thereto for all purposes. Moreover, besides gravure printing, it should be understood that other printing techniques, such as flexographic printing, may also be used to apply the polymer latex.

Figure 4:
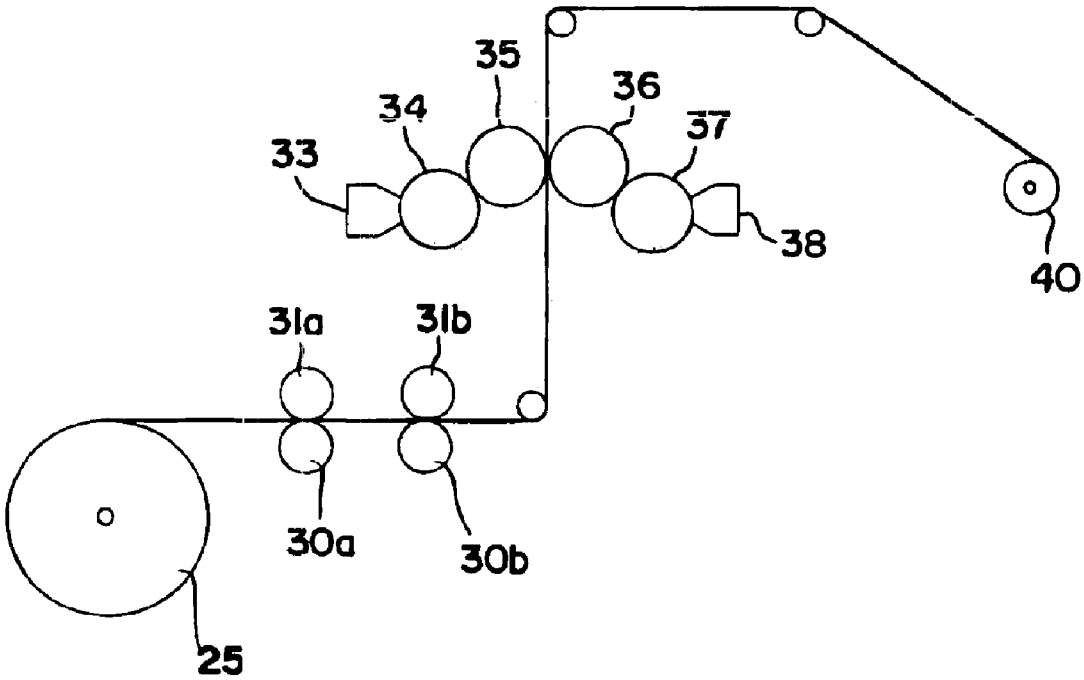
FIG. 4 is a schematic diagram of a method for rotogravure coating a polymer latex onto a web in accordance with one embodiment of the present invention.

For example, referring to FIG. 4, one embodiment of a method for applying the polymer latex to web using rotogravure printing is illustrated. As shown, the parent roll 25 (See FIG. 3) is unwound and passed through two calender nips between calender rolls 30*a* and 31*a* and 30*b* and 31*b*. The calendered web is then passed to the rotogravure coating station that includes a first closed doctor chamber 33 containing the polymer latex to be applied to a first side of the web, a first engraved steel gravure roll 34, a first rubber backing roll 35, a second rubber backing roll 36, a second engraved steel gravure roll 37, and a second closed doctor chamber 38 containing the polymer latex to be applied to the second side of the web. If both sides of the web are to be treated, the two polymer lattices can be the same or different. The calendered web passes through a fixed-gap nip between the two rubber backing rolls where the polymer latex is applied to the web. The treated web may then optionally be cured and passed to a rewinder where it is wound onto logs 40 and slit into rolls of tissue. Although not required, curing can further enhance the strength of the tissue product. For most polymer lattices, substantial curing can occur at a temperature of about 130° C. or more. If desired, curing can occur at a temperature that is approximately the same or greater than the melting point of one or more components of the synthetic fibers. In this manner, the synthetic fibers can bond together at the same time that the latex is cured.

Further, the polymer latex may also be sprayed onto the dry web and optionally cured. Any equipment suitable for spraying an additive onto a paper web may be utilized in the present invention. For instance, one example of suitable spraying equipment includes external mix, air atomizing nozzles, such as the 2 mm nozzle available from V.I.B. Systems, Inc., Tucker, Ga. Another nozzle that can be used is an H ⅛" VV-SS 650017 VeeJet spray nozzle available from Spraying Systems, Inc. of Milwaukee, Wis. Still other spraying techniques and equipment are described in U.S. Pat. No. 5,164,046 to Ampulski, et al., which is incorporated herein in its entirety by reference thereto for all purposes. In addition, besides the techniques referenced above, other well-known techniques for applying a composition to a dried web, such as extrusion, etc., may also be used in the present invention. Besides the above-mentioned techniques, the polymer latex may also be applied as a foam composition and optionally cured. For instance, several suitable techniques for forming a foam composition and applying the composition to a dry web are described in WO 02/16689, which is incorporated herein in its entirety by reference thereto for all purposes.

As a result of the present invention, it has been discovered that a tissue product can be formed that is durable, i.e., has improved wet strength. For example, when wet, the tissue product can have a relatively high tensile strength in the cross-direction, which is typically the weakest direction for tissue products. Due to its high wet strength, the tissue product can have a relatively high ratio of wet tensile strength to dry tensile strength in the cross-direction, which is generally the weakest direction of the tissue product. For example, the resulting tissue product may exhibit a wet-to-dry tensile strength ratio in the cross-direction of about 0.20 or more, in some embodiments about 0.30 or more, and in some embodiments, about 0.40 or more. It is believed that such improved strength is achieved through the synergistic combination of synthetic fibers and polymer latex treatment. Specifically, although not limited in theory, it is believed that the polymer latex applied to the outer layer(s) of the tissue product can bind to the synthetic fibers contained therein, thereby forming a strength-enhancing network. In addition, besides exhibiting improved strength, the tissue product of the present invention may also produce relatively low levels of lint and slough. For instance, it is believed that the relatively long synthetic fibers are able to entangle themselves around the relatively short pulp fibers, thereby inhibiting their removal from the surface of the tissue product by way of lint and/or slough.

The present invention may be better understood with reference to the following examples.

Test Methods

The tensile strength of the samples set forth in the Example was determined as follows.

Tensile Strength

MD and CD tensile strengths (wet and dry) were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4 inch gauge length for facial tissue and 2 inch gauge length for bath tissue. The crosshead speed during the test was 10 in./minute. The tester was connected with a computer loaded with data acquisition system; e.g., MTS TestWork for windows software. Readings were taken directly from a computer screen readout at the point of rupture to obtain the tensile strength of an individual sample. The geometric mean tensile strength (GMT) was also calculated as the square root of the product of dry MD tensile strength and dry CD tensile strength in units of grams per 3 inches of a sample.

EXAMPLE

The ability to form a paper web with enhanced strength was demonstrated. Five samples (Samples 1–5) of a 1-ply tissue product that contained 3 layers were formed on a continuous former such as described above and shown in FIG. 3. The inner layer of the base sheet contained 50% LL-19 softwood fibers available from Kimberly-Clark and 50% bleached chemithermomechanical pulp fibers and constituted 50% by weight of the sheet. Each outer layer constituted 25% by weight of the basesheet. The constituents of the outer layers are set forth below in Table 1.

TABLE 1

Outer Layers of Samples 1–5

| Sample | Composition | Debonder (kg/metric ton) |
|---|---|---|
| 1 | 100% LL-19 softwood fibers | 4.5 |
| 2 | 90% LL-19 softwood fibers and 10% synthetic fibers | 4.0 |
| 3 | 80% LL-19 softwood fibers and 20% synthetic fibers | 2.5 |
| 4 | 90% LL-19 softwood fibers and 10% synthetic fibers | 6.0 |
| 5 | 80% LL-19 softwood fibers and 20% synthetic fibers | 8.0 |

The synthetic fibers for Samples 2–3 were T103 polyester (PET) fibers, which are available from Kosa, Inc. of Salisbury, N.C. These fibers had a denier of 1.5 and were cut to a length of 6 millimeters. The density of PET was about 1.3 g/cm$^3$, which compared to a density of about 1.38 g/cm$^3$ for pulp fibers and a density of about 1 g/cm$^3$ for water. The density imbalance ($\Delta\rho$), which is defined as the difference in density between the water and the fiber ($\Delta\rho=\rho_{water}-\rho_{fiber}$) was thus about −0.4 g/cm$^3$. The melting temperature of the PET was about 518° F.

The synthetic fibers for Samples 4–5 were Celbond® Type 105 polyethylene/polyester (PE/PET) fibers, which are available from Kosa, Inc. of Salisbury, N.C. These fibers had a denier of 3 and were cut to a length of 6 millimeters. The mass fraction of PE and PET was about 50%. The density of PE was about 0.91 g/cm$^3$ and the density of PET was about 1.38 g/cm$^3$, so that the resulting bicomponent density was about 1.15 g/cm$^3$, which compared to a density of about 1.3 g/cm$^3$ for pulp fibers and a density of about 1 g/cm$^3$ for water. The density imbalance ($\Delta\rho$), which is defined as the difference in density between the water and the fiber ($\Delta\rho=\rho_{water}-\rho_{fiber}$) was thus about −0.15 g/cm$^3$. The melting temperature of the PE sheath was about 279° F.

The synthetic fibers were prepared as follow. First, 50 lbs of the LL-19 softwood fibers were refined for 25 minutes in the pulper and transferred to a machine chest. 200 lbs of the synthetic fibers were then added to the pulper and mixed without refining for 30 seconds. The synthetic fiber suspension was then transferred to the softwood fibers in the dump chest and diluted to a fiber consistency of 8.6 grams per liter (0.86%). Softwood fibers (LL-19) and BCTMP were prepared in 2 other machine chests. Prosoft TQ 100, a quaternary amine imidazoline softener available from Hercules, Inc., was added to all layers at the stuff box directly in the fan pump feeding line. The strength (GMT) of the tissue was adjusted to around 1100 grams per 3 inches with the softener addition.

Various properties of the resulting tissue product are set forth below in Table 2.

TABLE 2

Properties of the Untreated Tissue Product

| Sample | Basis weight (g/m$^2$) | Caliper (mil) | Dry MD Tensile Strength (g/3") | Dry CD Tensile Strength (g/3")* | Dry GMT (g/3") |
|---|---|---|---|---|---|
| 1 | 57.7 | 48.2 | 1248 | 1141 | 1192 |
| 2 | 58.2 | 48.8 | 1190 | 1075 | 1131 |
| 3 | 58.6 | 48.9 | 939 | 1009 | 973 |
| 4 | 58.8 | 46.7 | 1358 | 1113 | 1229 |
| 5 | 57.0 | 43.0 | 1154 | 1001 | 1075 |

Samples 1–5 were then calendered using a steel/steel nip and a pressure of 20 pounds per linear inch. Each side of the calendered samples were then flexographically printed with EN1165, an ethylene-vinyl acetate co-polymer latex available from Air Products, Inc ($T_g$=0° C.), with a printing gap of 0.002 inches. The resulting samples had a polymer latex concentration of between 6% to 8% by weight of the dry fibrous material within the web. The polymer latex-treated samples were then cured at 180–200° C. for 0.5 seconds. Various properties of the resulting tissue product are set forth below in Table 3.

TABLE 3

Properties of the Polymer Latex-Treated Tissue Product

| Sample | Basis weight (g/m$^2$) | Caliper (mil) | Dry MD Tensile Strength (g/3") | Dry CD Tensile Strength (g/3") | Dry GMT (g/3") | Wet CD Tensile Strength (g/3") | Ratio of Wet CD/Dry CD |
|---|---|---|---|---|---|---|---|
| 1 | 57.7 | 23.3 | 2277 | 1620 | 1921 | 646.5 | 0.40 |
| 2 | 58.2 | 25.7 | 2228 | 1632 | 1970 | 649.8 | 0.40 |
| 3 | 58.6 | 26.4 | 2236 | 1579 | 1879 | 646.3 | 0.41 |
| 4 | 58.8 | 25.4 | 2500 | 1786 | 2112 | 830.7 | 0.47 |
| 5 | 57.0 | 23.3 | 2871 | 1909 | 2341 | 934.9 | 0.49 |

As indicated, the synthetic-fiber containing samples that were treated with the polymer latex had a relatively high wet tensile strength and wet-to-dry tensile strength in the cross-direction, and also a relatively high dry machine and cross direction tensile strength.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a tissue product, said method comprising;

forming a multi-layered paper web that includes at least one outer layer, wherein said outer layer comprises a blend of pulp fibers and synthetic fibers in an amount from about 0.1% to about 20% by weight of said layer so that the total amount of synthetic fibers present within said web is from about 0.1% to about 20% by weight;

drying said multi-layered paper web; and applying a polymer latex to said outer layer;

wherein said multi-layered paper web is uncreped.

2. A method as defined in claim 1, wherein said polymer latex has a glass transition temperature of from about −25° C. to about 30° C.

3. A method as defined in claim 1, wherein said polymer latex comprises from about 0.1% to about 10% of the dry weight of said web.

4. A method as defined in claim 1, wherein said multi-layered web is through-dried.

5. A method as defined in claim 1, wherein the total amount of synthetic fibers present within said web is from about 0.1% to about 10% by weight.

6. A method as defined in claim 1, wherein said web is dried at a temperature that is greater than or equal to the melting point of one or more components of said synthetic fibers.

7. A method as defined in claim 1, wherein said web is dried at a temperature that is less than the melting point of one or more components of said synthetic fibers.

8. A method as defined in claim 1, wherein the tissue product has a wet-to-dry tensile strength ratio in the cross-direction of about 0.20 or more.

9. A method as defined in claim 1, wherein the tissue product has a wet-to-dry tensile strength ratio in the cross-direction of about 0.30 or more.

10. A method as defined in claim 1, wherein the tissue product has a wet-to-dry tensile strength ratio in the cross-direction of about 0.40 or more.

11. A method as defined in claim 1, wherein the polymer latex is printed onto said outer layer.

12. A method as defined in claim 11, wherein said polymer latex is cured at a temperature above or equal to the melting point of one or more components of said synthetic fibers.

13. A method as defined in claim 1, further comprising curing said polymer latex.

14. A method as defined in claim 1, wherein said synthetic fibers are multicomponent fibers.

15. A method as defined in claim 1, wherein said polymer latex comprises from about 0.1% to about 7% of the dry weight of said web.

16. A method as defined in claim 1, wherein said polymer latex is selected from the group consisting of styrene-butadiene copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, and nitrile polymers.

17. A method as defined in claim 1, wherein said paper web further comprises a debonder.

18. A method as defined in claim 1, wherein said synthetic fibers have a density imbalance of from about −0.2 to about +0.5 grams per cubic centimeter.

19. A method as defined in claim 1, wherein said synthetic fibers have a density imbalance of from about −0.2 to about +0.4 grams per cubic centimeter.

20. A method as defined in claim 1, wherein said synthetic fibers have a density imbalance of from about −0.1 to about +0.4 grams per cubic centimeter.

21. A method as defined in claim 1, wherein said multi-layered web forms a first ply of the tissue product.

22. A method as defined in claim 21, wherein a second ply is positioned adjacent to said first ply.

23. A method for forming a tissue product, said method comprising;

forming a multi-layered paper web that includes at least one outer layer, wherein said outer layer comprises a blend of pulp fibers and synthetic multicomponent fibers in an amount from about 0.1% to about 20% by weight of said layer so that the total amount of synthetic multicomponent fibers present within said web is from about 0.1% to about 20% by weight, wherein said synthetic multicomponent fibers have a density imbalance of from about −0.2 to about +0.5 grams per cubic centimeter;

through-drying said multi-layered paper web; and thereafter, printing a polymer latex onto said outer layer, said polymer latex having a glass transition temperature of from about −25° C. to about 30° C.;

wherein said multi-layered paper web is uncreped.

24. A method as defined in claim 23, wherein said polymer latex comprises from about 0.1% to about 10% of the dry weight of said web.

25. A method as defined in claim 23, wherein the total amount of synthetic multicomponent fibers present within said web is from about 0.1% to about 10% by weight.

26. A method as defined in claim 23, wherein said web is dried at a temperature that is greater than or equal to the melting point of one or more components of said synthetic fibers.

27. A method as defined in claim 23, wherein said web is dried at a temperature that is less than the melting point of one or more components of said synthetic fibers.

28. A method as defined in claim 23, wherein the tissue product has a wet-to-dry tensile strength ratio in the cross-direction of about 0.20 or more.

29. A method as defined in claim 23, wherein the tissue product has a wet-to-dry tensile strength ratio in the cross-direction of about 0.30 or more.

30. A method as defined in claim 23, wherein the tissue product has a wet-to-dry tensile strength ratio in the cross-direction of about 0.40 or more.

31. A method as defined in claim 23, further comprising curing said polymer latex.

32. A method as defined in claim 31, wherein said polymer latex is cured at a temperature above or equal to the melting point of one or more components of said synthetic fibers.

33. A method as defined in claim 23, wherein said synthetic fibers have a density imbalance of from about −0.2 to about +0.4,grams per cubic centimeter.

34. A method as defined in claim 23, wherein said synthetic fibers have a density imbalance of from about −0.1 to about +0.4 grams per cubic centimeter.

35. A method as defined in claim 23, wherein said multi-layered web forms a first ply of the tissue product.

36. A method as defined in claim 35, wherein a second ply is positioned adjacent to said first ply.

37. A method for forming a tissue product, said method comprising;

forming a multi-layered paper web that includes at least one outer layer, wherein said outer layer comprises a blend of pulp fibers and synthetic bicomponent fibers in an amount from about 0.1% to about 10% by weight of said layer so that the total amount of synthetic bicomponent fibers present within said web is from about 0.1% to about 10% by weight, wherein said synthetic bicomponent fibers have a density imbalance of from about −0.2 to about +0.5 grams per cubic centimeter;

through-drying said multi-layered paper web; and thereafter, applying a polymer latex to said outer layer, said polymer latex having a glass transition temperature of from about −25° C. to about 30° C.;

wherein said multi-layered paper web is uncreped.

38. A method as defined in claim 37, wherein said web is dried at a temperature that is greater than or equal to the melting point of one or more components of said synthetic fibers.

39. A method as defined in claim 37, wherein said web is dried at a temperature that is less than the melting point of one or more components of said synthetic fibers.

40. A method as defined in claim 37, wherein the tissue product has a wet-to-dry tensile strength ratio in the cross-direction of about 0.20 or more.

41. A method as defined in claim 37, wherein the tissue product has a wet-to-dry tensile strength ratio in the cross-direction of about 0.30 or more.

42. A method as defined in claim 37, wherein the tissue product has a wet-to-dry tensile strength ratio in the cross-direction of about 0.40 or more.

43. A method as defined in claim 37, further comprising curing said polymer latex.

44. A method as defined in claim 43, wherein said polymer latex is cured at a temperature above or equal to the melting point of one or more components of said synthetic fibers.

45. A method as defined in claim 37, wherein said synthetic fibers have a density imbalance of from about −0.2 to about +0.4 grams per cubic centimeter.

46. A method as defined in claim 37, wherein said synthetic fibers have a density imbalance of from about −0.1 to about +0.4 grams per cubic centimeter.

* * * * *